US008346149B2

(12) United States Patent
Fukuhata

(10) Patent No.: US 8,346,149 B2
(45) **Date of Patent: *Jan. 1, 2013**

(54) FIXING DEVICE AND IMAGE FORMING APPARATUS INCORPORATING SAME

(75) Inventor: Yoshihiro Fukuhata, Takaraduka (JP)

(73) Assignee: Ricoh Company, Limited, Tokyo (JP)

( * ) Notice: Subject to any disclaimer, the term of this patent is extended or adjusted under 35 U.S.C. 154(b) by 446 days.

This patent is subject to a terminal disclaimer.

(21) Appl. No.: 12/686,706

(22) Filed: Jan. 13, 2010

(65) Prior Publication Data

US 2010/0178089 A1 Jul. 15, 2010

(30) Foreign Application Priority Data

Jan. 14, 2009 (JP) ..... 2009-005710
Mar. 27, 2009 (JP) ..... 2009-079456
Sep. 24, 2009 (JP) ..... 2009-219076

(51) Int. Cl.
*G03G 15/20* (2006.01)

(52) U.S. Cl. ..... 399/333

(58) Field of Classification Search ..... 399/69, 399/122, 320, 322, 328, 330, 331, 333, 334
See application file for complete search history.

(56) References Cited

U.S. PATENT DOCUMENTS 5,450,181 A * 9/1995 Tsukida et al. ..... 399/322
5,689,789 A * 11/1997 Moser ..... 399/331
5,737,679 A * 4/1998 Uehara et al. ..... 399/329
2007/0223976 A1 9/2007 Yagi et al.
2008/0013992 A1 1/2008 Fukuhata et al.
2008/0013993 A1 1/2008 Obata et al.
2008/0031664 A1 2/2008 Yagi et al.
2008/0063442 A1 3/2008 Yagi et al.
2008/0069611 A1 3/2008 Obata et al.
2010/0239297 A1* 9/2010 Sakaya et al. ..... 399/69
2010/0260524 A1* 10/2010 Hiraoka et al. ..... 399/329

(Continued)

FOREIGN PATENT DOCUMENTS

JP 7-129014 5/1995

(Continued)

OTHER PUBLICATIONS

Machine translation of reference Goto et al, (JP 07-129,014 A), Listed in IDS, Pub date May 19, 1995.*

*Primary Examiner* — Walter L Lindsay, Jr.
*Assistant Examiner* — Rodney Bonnette
(74) *Attorney, Agent, or Firm* — Oblon, Spivak, McClelland, Maier & Neustadt, L.L.P.

(57) ABSTRACT

A fixing device includes a first member and a second member. The first member extends along a first longitudinal axis, and has a first elastic layer whose thickness varies along the first longitudinal axis to define at least one first convex portion and at least one first concave portion. The second member extends along a second longitudinal axis parallel to the first longitudinal axis, and has a second elastic layer whose thickness varies along the second longitudinal axis to define at least one second convex portion and at least one second concave portion. At least one of the first and second members is heated, and at least one of the first and second members is pressed against the other, with the first convex portion engaging the second concave portion and the first concave portion engaging the second convex portion, to define a fixing nip therebetween.

15 Claims, 11 Drawing Sheets

U.S. PATENT DOCUMENTS

| | | | | |
|---|---|---|---|---|
| 2010/0272481 | A1* | 10/2010 | Yamamoto et al. | 399/328 |
| 2010/0296848 | A1* | 11/2010 | Yamamoto et al. | 399/328 |
| 2011/0052285 | A1* | 3/2011 | Fukuhata | 399/333 |
| 2012/0020690 | A1* | 1/2012 | Yamamoto et al. | 399/69 |

FOREIGN PATENT DOCUMENTS

| | | |
|---|---|---|
| JP | 7-104636 | 11/1995 |
| JP | 3119405 | 10/2000 |
| JP | 2001-265146 | 9/2001 |
| JP | 3267416 | 1/2002 |
| JP | 2004-109697 | 4/2004 |
| JP | 2005-284089 | 10/2005 |
| JP | 2005-352297 | 12/2005 |
| JP | 2008-20821 | 1/2008 |

* cited by examiner

FIXING DEVICE AND IMAGE FORMING APPARATUS INCORPORATING SAME

CROSS-REFERENCE TO RELATED APPLICATIONS

The present patent application claims priority pursuant to 35 U.S.C. §119 from Japanese Patent Applications Nos. 2009-005710, 2009-079456, and 2009-219076, filed on Jan. 14, 2009, Mar. 27, 2009, and Sep. 24, 2009, respectively, which are hereby incorporated by reference herein in their entirety.

BACKGROUND OF THE INVENTION

1. Field of the Invention

The present invention relates to a fixing device and an image forming apparatus incorporating the same, and more particularly, to a fixing device that fixes a toner image in place on a recording medium with heat and pressure, and an electrophotographic image forming apparatus incorporating such a fixing device.

2. Discussion of the Background

In electrophotographic image forming apparatus, such as photocopiers, facsimiles, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing device, which permanently fixes the toner image in place on the recording medium by melting and settling toner with heat and pressure.

Various types of fixing devices are known in the art, most of which employ a pair of parallel, elongated fixing members, at least one of which is heated and/or pressed against the other to define a line of contact called a fixing nip, through which a recording medium is passed under heat and pressure during the fixing process. Typical configurations of such fixing devices include a pair of cylindrical rollers, one internally heated and the other pressed against the heated one, and a combination of an internally heated cylindrical roller with a stationary member pressed against the heated roller through an endless looped belt.

FIG. 1 schematically illustrates a conventional fixing device employing an internally heated fuser roller 100 and a pressure roller 200 pressed together to form a fixing nip N therebetween.

As shown in FIG. 1, during operation, the fixing device rotates the fuser roller 100 counterclockwise and the pressure roller 200 clockwise in the drawing to feed a recording sheet S bearing a powder toner image T thereon along a sheet feed path A, which is, for example, tangent to the surfaces of the opposing rollers 100 and 200. As the sheet S enters the fixing nip N, the toner image T comes into contact with the heated surface of the fuser roller 100. At the fixing nip N, the fuser roller 100 melts toner particles with heat, while the pressure roller 200 promotes settling of the molten toner by pressing the sheet S against the fuser roller 100. The toner image T thus processed under heat and pressure then cools and solidifies and becomes fixed in place as the sheet S exits the fixing nip N to advance along the sheet feed path A.

One problem encountered by such an electrophotographic fixing device is that the recording sheet S deviates from the intended path A where the toner image T, melting and becoming tacky during fixing, adheres to the surface of the fuser roller 100 to lift, or tilt, the sheet S toward the roller 100 downstream of the fixing nip N. If the adhesion of molten toner is severe enough, it tilts a recording sheet S beyond a threshold tilt angle θ in an oblique direction B with respect to the proper sheet path A. The threshold tilt angle θ here indicates a maximum allowable tilt or deviation from the sheet feed path A with which the fixing device can separate a recording sheet S from the fuser roller 100 for forwarding it through the fixing nip N. Violating this threshold θ results in the sheet S wrapping around the fuser roller 100 to cause a jam at the fixing nip N.

To illustrate the tilt threshold in terms of a force F exerted on a recording sheet passing through the fixing nip N, proper sheet separation and forwarding occurs when the following inequality is satisfied:

$$F1<F2$$

where F1 represents strength of adhesion of molten toner to the surface of the fuser roller 100, and F2 represents a bending force required to tilt the recording sheet S beyond the threshold angle θ from the proper sheet path A. Typically, with the toner adhesion being fixed, using thicker and stiffer recording sheets and a fuser roller of smaller diameter results in greater threshold tilt angle θ' and a higher bending force F2 required to pass that threshold tilt angle θ'.

To simultaneously provide both adequate fixing and smooth sheet feeding, conventional fixing devices use toner with wax or some other release agent added thereto to obtain a smaller adhesion force F1, or employ a fuser roller of a smaller diameter to obtain a higher allowable bending force F2. However, such conventional approaches remain unsuccessful where the fixing device processes thin recording sheets which are less stiff and more ready to bend than normal copy sheets. That is, using a relatively thin recording sheet means an allowable bending force F2 lower than that normally accommodated, which makes it difficult for the conventional fixing device to provide proper sheet feeding without wraparound and concomitant sheet jam at the fixing nip.

Another problem associated with an electrophotographic fixing device is the difficulty in maintaining a uniform pressure distribution throughout a fixing nip. This is particularly true where the fixing device uses a precisely cylindrical fixing roller in conjunction with an axially tapered, symmetrical fixing roller that has a diameter greatest at the center and smallest at each end (a "crowned" configuration), or conversely, greatest at each end and smallest at the center (a "bowed" configuration), which enables proper sheet feeding at relatively high speeds through the fixing nip. When juxtaposed and pressed against each other, a tapered roller and a cylindrical roller contact each other at higher pressures where the tapered roller diameter is greatest and at lower pressures where the tapered roller diameter is smallest, resulting in variation in nip pressure along the fixing nip.

It is known that variation in nip pressure translates into variation in gloss of a resulting image. That is, a printed image will be low in gloss where it is processed at relatively low pressures and high in gloss where it is processed at relatively high pressures. Such variation in gloss can detract from the appearance of the image, which is not acceptable for applications in today's high quality image forming apparatuses.

Hence, there is a need for an electrophotographic fixing device that employs a pair of fixing members defining a fixing nip therebetween, through which a recording medium can go through fixing process under a uniform pressure without wrapping around the fixing member to provide high quality printing with uniform gloss across the entire resulting image.

SUMMARY OF THE INVENTION

Exemplary aspects of the present invention are put forward in view of the above-described circumstances, and provide a novel fixing device that fixes a toner image in place on a recording medium.

In one exemplary embodiment, the novel fixing device includes a first member and a second member. The first member extends along a first longitudinal axis, and has a first elastic layer whose thickness varies along the first longitudinal axis to define at least one first convex portion curving outward and at least one first concave portion curving inward with respect to the first longitudinal axis. The second member extends along a second longitudinal axis parallel to the first longitudinal axis, and has a second elastic layer whose thickness varies along the second longitudinal axis to define at least one second convex portion curving outward and at least one second concave portion curving inward with respect to the second longitudinal axis. At least one of the first and second members is heated, and at least one of the first and second members is pressed against the other, with the first convex portion engaging the second concave portion and the first concave portion engaging the second convex portion, to define a fixing nip therebetween through which the recording medium is passed to fix the toner image under heat and pressure.

Other exemplary aspects of the present invention are put forward in view of the above-described circumstances, and provide a novel image forming apparatus.

In one exemplary embodiment, the novel image forming apparatus includes an electrophotographic mechanism and a fixing unit. The electrophotographic mechanism forms a toner image on a recording medium. The fixing unit fixes the toner image in place on the recording medium. The fixing unit includes a first member and a second member. The first member extends along a first longitudinal axis, and has a first elastic layer whose thickness varies along the first longitudinal axis to define at least one first convex portion curving outward and at least one first concave portion curving inward with respect to the first longitudinal axis. The second member extends along a second longitudinal axis parallel to the first longitudinal axis, and has a second elastic layer whose thickness varies along the second longitudinal axis to define at least one second convex portion curving outward and at least one second concave portion curving inward with respect to the second longitudinal axis. At least one of the first and second members is heated, and at least one of the first and second members is pressed against the other, with the first convex portion engaging the second concave portion and the first concave portion engaging the second convex portion, to define a fixing nip therebetween through which the recording medium is passed to fix the toner image under heat and pressure.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
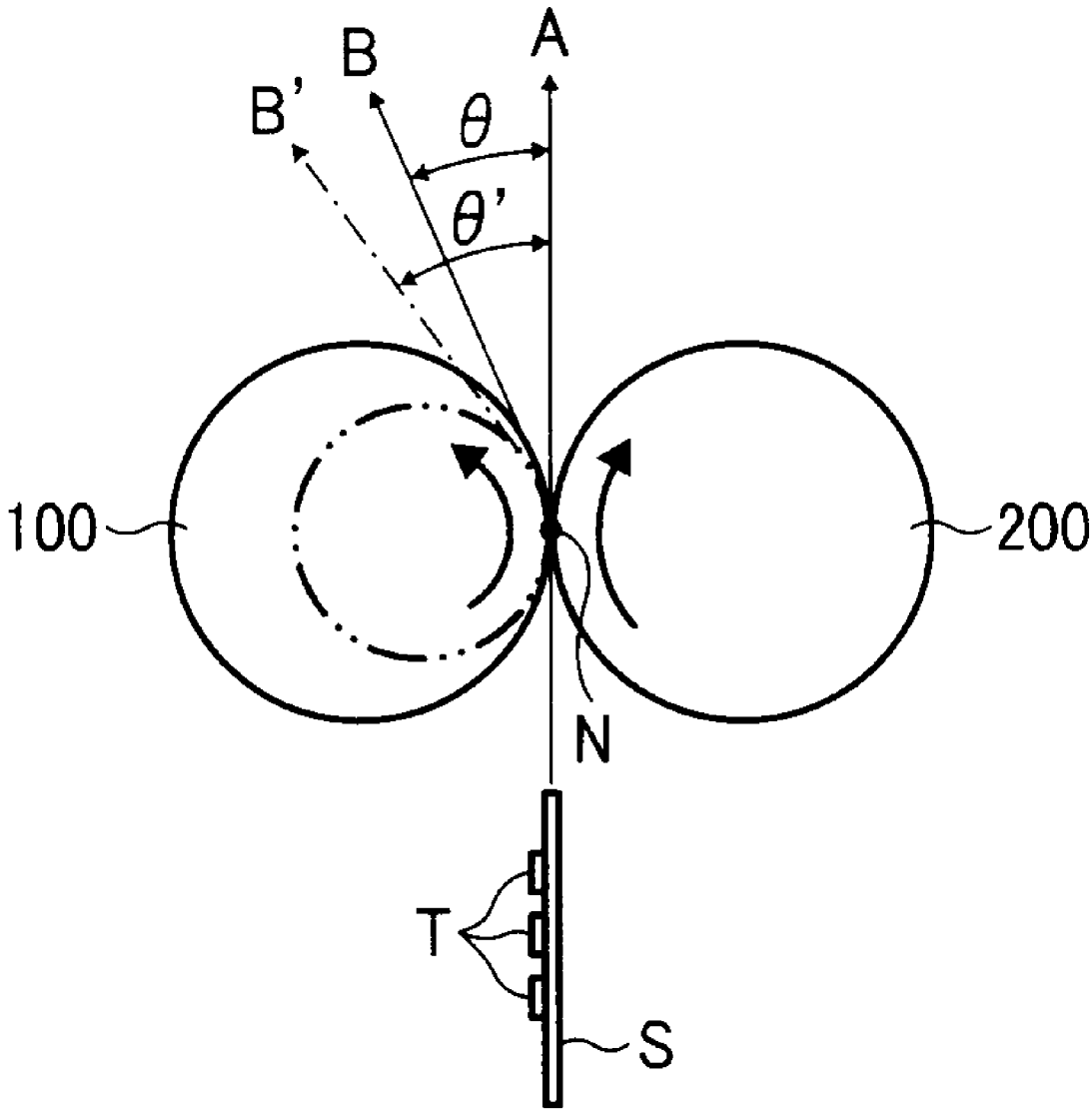
FIG. 1 BACKGROUND ART
FIG. 1 schematically illustrates a conventional fixing device employing an internally heated fuser roller and a pressure roller.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

Figure 2:
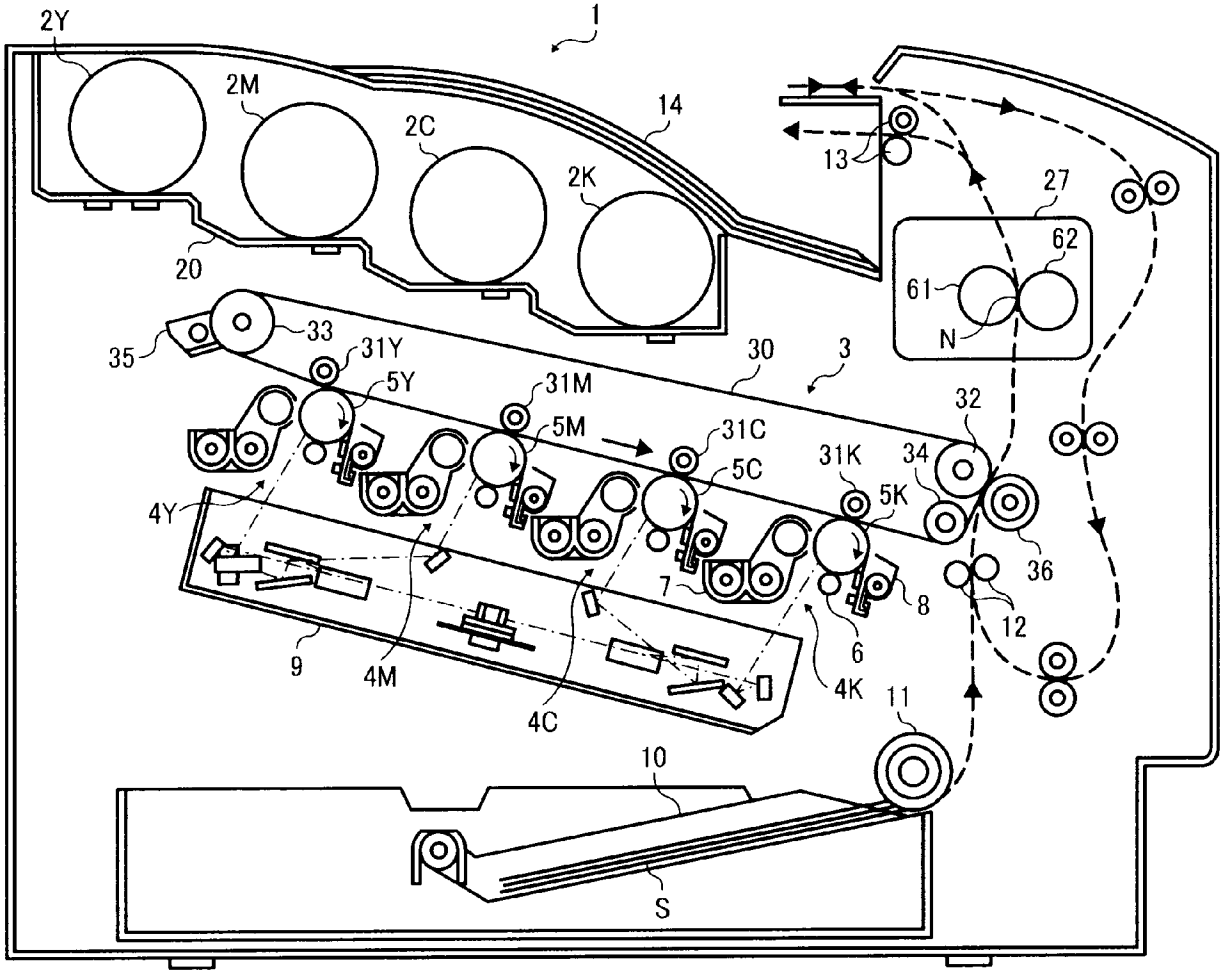
FIG. 2 schematically illustrates an example of an image forming apparatus incorporating a fixing device according to this patent specification.

FIG. 2 schematically illustrates an example of an image forming apparatus 1 incorporating a fixing device 27 according to this patent specification.

As shown in FIG. 2, the image forming apparatus 1 is a tandem color printer including four imaging stations 4Y, 4M, 4C, and 4K arranged in series along the length of an intermediate transfer unit 3 and adjacent to a write scanner 9, which together form an electrophotographic mechanism to form an image with toner particles on a recording medium such as a sheet of paper S. The image forming apparatus 1 also includes a feed roller 11, a pair of registration rollers 12, and a pair of ejection rollers 13 together defining a sheet feed path, indicated by dotted arrows in the drawing, along which a recording sheet S advances toward an output tray 14 atop the apparatus 1 from a sheet feed tray 10 accommodating a stack of recording sheets at the bottom of the apparatus 1 through the fixing device 27 according to this patent specification.

In the image forming apparatus 1, each imaging unit (indicated collectively by the reference numeral 4) has a drum-shaped photoconductor 5 surrounded by a charging device 6, a development device 7, a cleaning device 8, a discharging device, not shown, etc., which work in cooperation to form a toner image of a particular primary color, as designated by the suffix letters, "Y" for yellow, "M" for magenta, "C" for cyan, and "K" for black. The imaging units 4Y, 4M, 4C, and 4K are supplied with toner from replaceable toner bottles 2Y, 2M, 2C, and 2K, respectively, accommodated in a toner supply 20 in the upper portion of the apparatus 1.

The intermediate transfer unit 3 includes an intermediate transfer belt 30, four primary transfer rollers 31Y, 31M, 31C, and 31K, and a belt cleaner 35, as well as a transfer backup roller or drive roller 32, a cleaning backup roller 33, and a tension roller 34 around which the intermediate transfer belt 30 is entrained. When driven by the roller 32, the intermediate transfer belt 30 travels counterclockwise in the drawing along an endless travel path, passing through four primary transfer nips defined between the primary transfer rollers 31 and the corresponding photoconductive drums 5, as well as a secondary transfer nip defined between the transfer backup roller 32 and a secondary transfer roller 36.

The fixing device 27 includes a pair of first and second fixing members 61 and 62, one being heated and the other being pressed against the heated one, to form a fixing nip N therebetween in the sheet feed path. Detailed description of several embodiments of the fixing device 27 according to this patent specification will be given with reference to FIG. 3 and subsequent drawings.

During operation, each imaging unit 4 rotates the photoconductor drum 5 clockwise in the drawing to forward its outer, photoconductive surface to a series of electrophotographic processes, including charging, exposure, development, transfer, and cleaning, in one rotation of the photoconductor drum 5.

First, the photoconductive surface is uniformly charged by the charging device 6 and subsequently exposed to a modulated laser beam emitted from the write scanner 3. The laser exposure selectively dissipates the charge on the photoconductive surface to form an electrostatic latent image thereon according to image data representing a particular primary color. Then, the latent image enters the development device which renders the incoming image into visible form using toner. The toner image thus obtained is forwarded to the primary transfer nip between the intermediate transfer belt 30 and the primary transfer roller 5.

At the primary transfer nip, the primary transfer roller 31 applies a bias voltage of a polarity opposite that of toner to the intermediate transfer belt 30. This electrostatically transfers the toner image from the photoconductive surface to an outer surface of the belt 30, with a certain small amount of residual toner particles left on the photoconductive surface. Such transfer process occurs sequentially at the four transfer nips along the belt travel path, so that toner images of different colors are superimposed one atop another to form a multicolor image on the surface of the intermediate transfer belt 30.

After primary transfer, the photoconductive surface enters the cleaning device 8 to remove residual toner by scraping off with a cleaning blade, and then to the discharging device to remove residual charges for completion of one imaging cycle. At the same time, the intermediate transfer belt 30 forwards the multicolor image to the secondary transfer nip between the transfer backup roller 32 and the secondary transfer roller 36.

In the sheet feed path, the feed roller 11 rotates counterclockwise in the drawing to introduce a recording sheet S from the sheet tray 10 toward the pair of registration rollers 12. The registration rollers 12 hold the fed sheet S, and then advance it in sync with the movement of the intermediate transfer belt 30 to the secondary transfer nip. At the secondary transfer nip, the multicolor image is transferred from the belt 30 to the incoming sheet S, with a certain small amount of residual toner particles left on the belt surface.

After secondary transfer, the intermediate transfer belt 30 enters the belt cleaner 35, which removes and collects residual toner from the intermediate transfer belt 30. At the same time, the recording sheet S bearing the powder toner image thereon is introduced into the fixing device 27, which fixes the multicolor image in place on the recording sheet S with heat and pressure through the fixing nip N.

Thereafter, the recording sheet S is ejected by the output rollers 13 to the output tray 14 to complete one operational cycle of the image forming apparatus 1.

Figure 3:
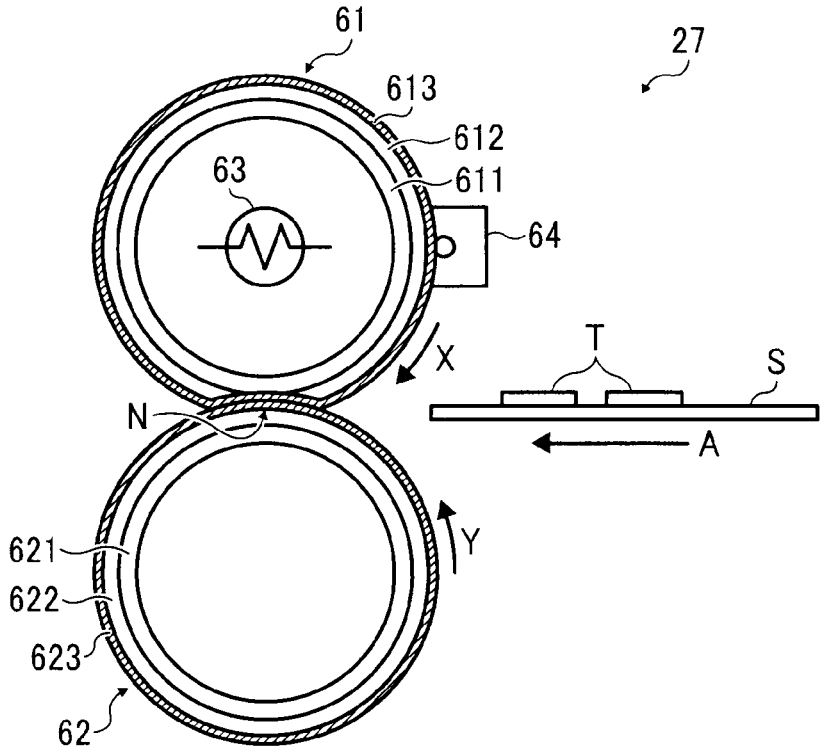
FIG. 3 is an end-on, axial view schematically illustrating one embodiment of the fixing device incorporated in the image forming apparatus according to this patent specification.

FIG. 3 is an end-on, axial view schematically illustrating one embodiment of the fixing device 27 incorporated in the image forming apparatus 1 according to this patent specification.

As shown in FIG. 3, in the present embodiment of the fixing device 27, the first fixing member comprises a fuser roller 61 extending along a longitudinal axis thereof, and the second fixing member comprises a pressure roller 62 extending along a longitudinal axis thereof. The fuser roller 61 and the pressure roller 62 can rotate around their respective longitudinal axes, while contacting each other with the longitudinal axes generally in parallel to form a fixing nip N therebetween.

The fuser roller 61 is formed of a hollow, cylindrical metal core 611 covered by a layer of elastic material 612 with a coating of release agent 613 applied to an outer surface of the elastic layer 612. The fuser roller 61 has a heat source such as a lamp heater 63 extending along the longitudinal axis to heat the roller body from within, as well as a thermometer 64 to sense temperature of the roller outer surface. The heater 63 and the thermometer 64 are connected to a controller, not shown, which controls the heater 63 according to readings of the thermometer 64 to maintain the temperature of the outer surface at a given processing temperature.

Similarly, the pressure roller 62 is formed of a hollow, cylindrical metal core 621 covered by a layer of elastic material 622 with a coating of release agent 623 applied to an outer surface of the elastic layer 622. The pressure roller 62 has a biasing mechanism, not shown, that presses the pressure roller 62 against the fuser roller 61.

During operation, the fixing device 27 rotates the fuser roller 61 in the direction of arrow X and the pressure roller 62 in the direction of arrow Y to feed a recording sheet S bearing a toner image T thereon in the direction of arrow A. At the same time, the fixing device 27 heats the outer surface of the fuser roller 61 to a temperature sufficient to melt the toner particles. As the sheet S enters the fixing nip N, the toner image T comes into contact with the heated surface of the fuser roller 61. At the fixing nip, the fuser roller 61 melts the toner particles with heat, while the pressure roller 62 promotes settling of the molten toner by pressing the sheet S against the fuser roller 61. The toner image T thus processed under heat and pressure then cools and solidifies and becomes fixed in place as the sheet S leaves the fixing nip N to advance along the sheet feed path A.

Figure 4:
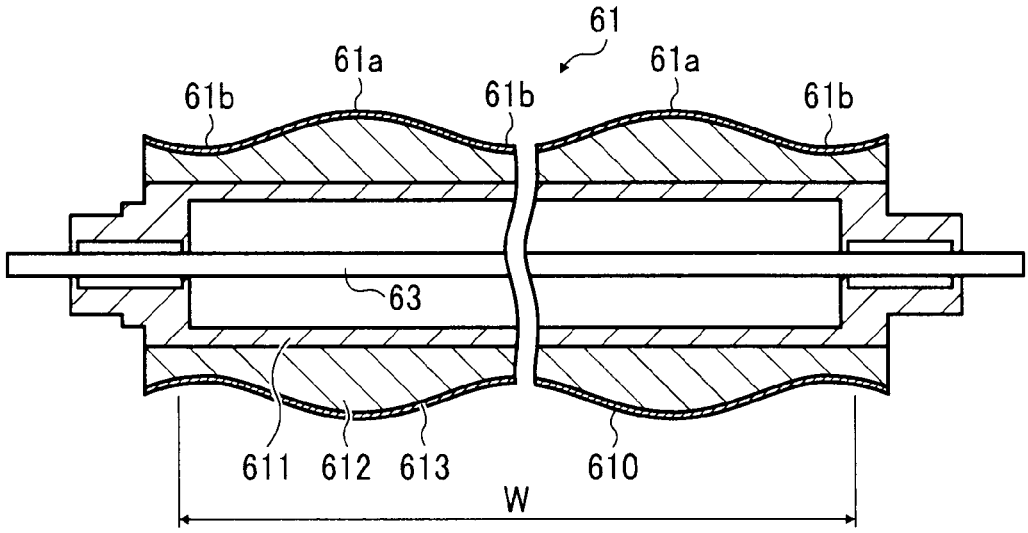
FIG. 4 schematically illustrates a fuser roller used in the fixing device of FIG. 3 along the longitudinal axis in transverse cross-section.

FIG. 4 schematically illustrates the fuser roller 61 along the longitudinal axis in transverse cross-section.

As shown in FIG. 4, the fuser roller 61 has an alternating series of at least one convex portion 61*a* curving outward and at least one concave portion 61*b* curving inward with respect to the longitudinal axis to define an undulating outer peripheral surface 610. The convex and concave portions 61*a* and 61*b* are formed by varying the thickness of the elastic layer 612, with the metal core 611 and the release coating 613 each having a substantially uniform thickness or cross-section along the longitudinal axis.

Each of the convex and concave portions 61*a* and 61*b* has a height with respect to a circumferential plane of the roller 61 in a range of, for example, approximately 0.1 mm to approximately 0.5 mm, and a width along the longitudinal axis of the roller 61 of, for example, approximately 10 mm. The number of convex portions 61*a* and concave portions 61*b* each may be any number equal to or greater than one.

In the present embodiment, the convex portion 61*a* and the concave portion 61*b* are contiguous to each other so that the roller surface 610 as a whole has a continuously undulating configuration, such as a sinusoidal curve or other suitable curve. A series of convex and concave portions 61*a* and 61*b* spans a width W indicating a maximum compatible sheet width of recording medium that the fixing device 27 can accommodate in the fixing nip N. Alternatively, the curving portions 61*a* and 61*b* may be present only over a portion of the maximum compatible sheet width W.

Figure 5:
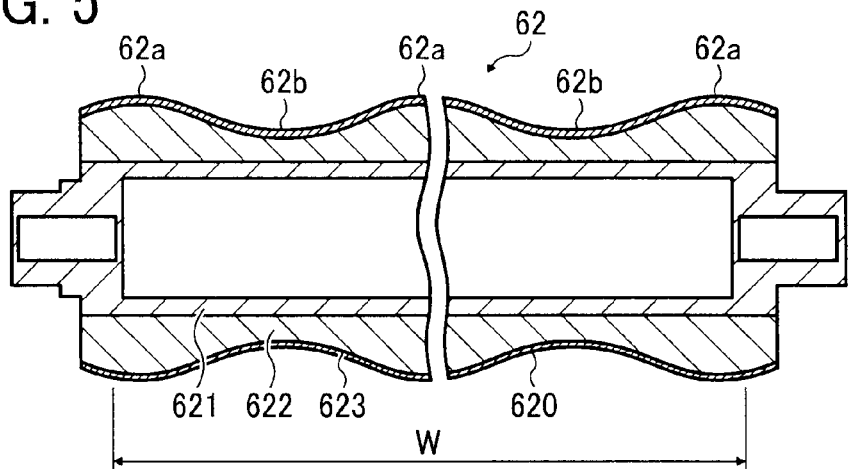
FIG. 5 schematically illustrates a pressure roller used in the fixing device of FIG. 3 along the longitudinal axis in transverse cross-section.

FIG. 5 schematically illustrates the pressure roller 62 along the longitudinal axis in transverse cross-section.

As shown in FIG. 5, the pressure roller 62 has an alternating series of at least one convex portion 62*a* curving outward and at least one concave portion 62*b* curving inward with respect to the longitudinal axis to define an undulating outer peripheral surface 620. The convex and concave portions 62*a* and 62*b* are formed by varying the thickness of the elastic layer 622, with the metal core 621 and the release coating 623 each having a substantially uniform thickness or cross-section along the longitudinal axis.

Each of the convex and concave portions 62*a* and 62*b* has a height with respect to a circumferential plane of the roller 62 in a range of, for example, approximately 0.1 mm to approximately 0.5 mm, and a width along the longitudinal axis of the roller 62 of, for example, approximately 10 mm. The number of convex portions 62*a* and concave portions 62*b* each may be any number equal to or greater than one.

In the present embodiment, as in the case of the fuser roller 61, the convex portion 62*a* and the concave portion 62*b* are contiguous to each other so that the roller surface 620 as a whole has a continuously undulating configuration, such as a sinusoidal curve or other suitable curve, and a series of convex and concave portions 62*a* and 62*b* of the pressure roller 62 may span all or part of the maximum compatible sheet width W.

In the fixing device 27, the fuser roller 61 has the same number of convex portions 61*a* as the number of concave portions 62*b* of the pressure roller 62, and the pressure roller 62 has the same number of convex portions 62*a* as the number of concave portions 61*b* of the fuser roller 61. The convex portions 61*a* of the fuser roller 61 are similar in dimension and position, and preferably, complementary in shape, to the concave portions 62*b* of the pressure roller 62 in the axial direction, and the convex portions 62*a* of the pressure roller 62 are similar in dimension and position, and preferably, complementary in shape, to the concave portions 61*b* of the fuser roller 61 in the axial direction. Such configuration of the fuser and pressure rollers 61 and 62 allows engagement and close contact between their undulating surfaces 610 and 620 by fitting the corresponding convex and concave portions when mounted in the fixing device 27 as described in detail with reference to FIG. 6.

Figure 6:
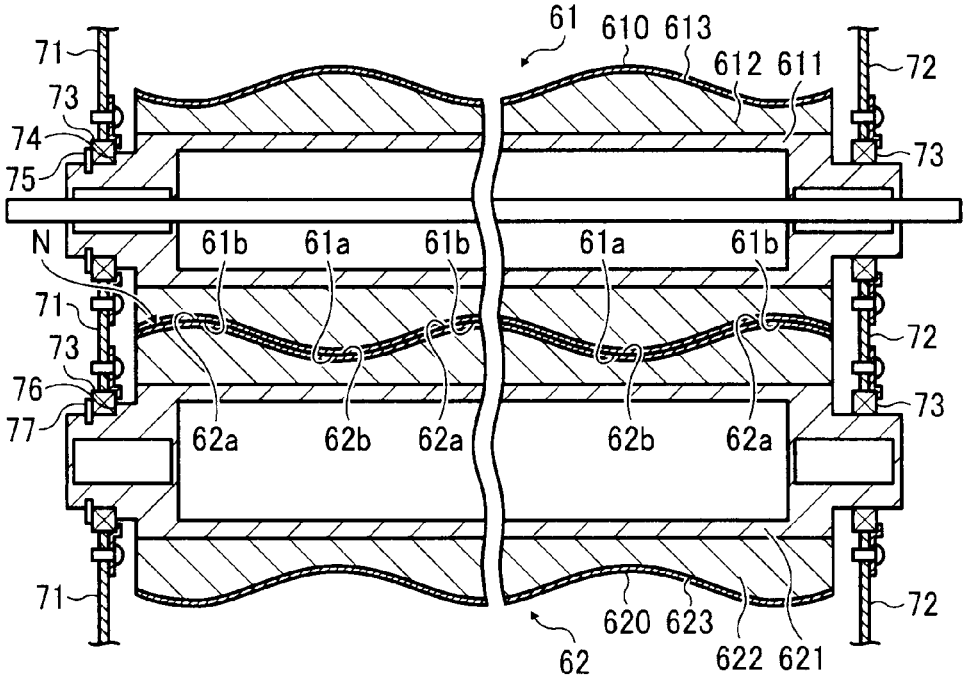
FIG. 6 shows the fuser roller and the pressure roller mounted in the fixing device of FIG. 3.

FIG. 6 shows the fuser roller 61 and the pressure roller 62 mounted in the fixing device 27, with the biasing mechanism of the pressure roller 62 being omitted for clarity.

As shown in FIG. 6, the fixing device 27 accommodates the fuser roller 61 and the pressure roller 62 between a pair of parallel left and right sidewalls 71 and 72 for installation in the image forming apparatus 1. When properly mounted, the rollers 61 and 62 have their cylindrical metal cores 611 and 621 uniformly spaced apart from each other and their undulating surfaces 610 and 620 engaged in pressure contact with each other along the fixing nip N, with each convex portion 61*a* of the fuser roller 61 fitting in the corresponding concave portion 62*b* of the pressure roller 62, and each convex portion 62*a* of the pressure roller 62 fitting in the corresponding concave portion 61*b* of the fuser roller 61.

In such a configuration, the fixing device 27 according to this patent specification can temporarily stiffen a recording sheet S during passage through the fixing nip N, so as to reliably feed the sheet S without wrapping the sheet S around the fuser roller 61 even when the sheet S in use is relatively thin and consequently ready to bend and deviate from the proper feed path A.

Specifically, with additional reference to FIG. 3, passing a recording sheet S through the fixing nip N during the fixing process causes the sheet S to conform to the undulating surfaces 610 and 620 of the fuser and pressure rollers 61 and 62. As the sheet S thus becomes undulated and corrugated, it temporarily exhibits an apparent stiffness greater than that exhibited without corrugation. Such temporary stiffening effect allows the recording sheet S to advance past the fixing nip N without wrapping around the fuser roller 61 and causing a jam at the fixing nip N, even when the sheet S in use is relatively thin and ready to bend due to adhesion of molten toner to the surface of the fuser roller 61.

Moreover, the fixing device 27 according to this patent specification can maintain a uniform pressure distribution throughout the fixing nip N to provide fixing with uniform gloss across a resulting image.

Specifically, the fuser and pressure rollers 61 and 62 contact each other at substantially uniform pressure along the fixing nip N owing to the engagement between the undulating surfaces 610 and 620 provided by fitting the corresponding convex and concave portions together. Since gloss of an image printed on a recording medium depends on the pressure applied to the recording medium during fixing, the uniform nip pressure exerted on the recording sheet S during passage through the fixing nip N provides uniform gloss across the image T.

Some conventional fixing devices use a precisely cylindrical fixing roller in conjunction with an axially tapered, symmetrical fixing roller that has a diameter greatest at the center and smallest at each end ("crowned"), or conversely, greatest at each end and smallest at the center ("bowed"). In contrast to the undulated fixing rollers 61 and 62 according to this patent specification, the conventional combination of cylindrical and tapered rollers often results in variation in nip pressure, since they contact each other at higher pressures where the tapered roller diameter is greatest and at lower pressures where the tapered roller diameter is smallest. Such higher and lower pressures present along the fixing nip translate into areas of higher and lower gloss appearing in a resulting image, which is not acceptable for applications in today's high quality image forming apparatuses.

Furthermore, the fixing device 27 according to this patent specification can maintain the undulating roller surfaces 610 and 620 in proper engagement with each other, thus ensuring uniform pressure distribution across the fixing nip N after installation of the fixing device 27.

Specifically, with continued reference to FIG. 6, the fuser roller 61 is mounted for rotation around the longitudinal axis with a pair of bearings 73 (e.g., ball bearings) one on each of the sidewalls 71 and 72. The bearing 73 on the left sidewall 71 is secured to the roller 61 by fitting between a flange 74 and a retaining ring 75 provided on the roller end, whereas the bearing 73 on the right sidewall 72 is not secured to the roller 61, thus allowing displacement of the fuser roller 61 with respect to the right sidewall 72 but not to the left sidewall 71 along the longitudinal axis.

Similarly, the pressure roller 62 is mounted for rotation around the longitudinal axis with a pair of bearings 73 (e.g., ball bearings) one on each of the sidewalls 71 and 72. The bearing 73 on the left sidewall 71 is secured to the roller 62 by fitting between a flange 76 and a retaining ring 77 provided on the roller end, whereas the bearing 73 on the right sidewall 72 is not secured to the roller 62, thus allowing displacement of the pressure roller 62 with respect to the right sidewall 72 but not to the left sidewall 71 along the longitudinal axis.

Thus, the fixing rollers 61 and 62 are mounted in the fixing device 27 with one end (in this case the left end) secured to the left sidewall 71 and the other end (in this case the right end) displaceable in the axial direction. Consequently, when the rollers 61 and 62 expand along their respective longitudinal axes by being heated to processing temperature during operation, they elongate solely on the right side while maintaining their left ends aligned with each other. This reduces the risk of misaligning corresponding concave and convex portions of the rollers 61 and 62 after installation of the fixing device 27, which would otherwise detract from uniform nip pressure and from uniform gloss of a resulting image.

For example, consider a case where the fixing device 27 uses the fuser roller 61 and the pressure roller 62 each formed of an aluminum core with a length of 240 mm and a thermal expansion coefficient of $2.42*10^{-6}$ per degree centigrade. The fuser roller 61, when heated from 20° C. to 180° C., extends by approximately 0.933 mm in the axial direction, while the pressure roller 62 extends by a similar amount in the same direction due to the heat conducted from the fuser roller 61. The result is the rollers 61 and 62 displaced relative to each other in the axial direction by an amount of approximately 0.5 mm or less, which is significantly smaller than that experienced by a conventional configuration of fixing rollers.

The side on which the rollers 61 and 62 are fixed or displaceable may be different than that depicted in FIG. 6, as long as the rollers 61 and 62 have one pair of adjacent longitudinal ends positioned in alignment with each other, and the other pair of adjacent longitudinal ends displaceable along the respective longitudinal axes. That is, the fixing rollers 61 and 62 may be mounted with their respective right ends secured to the right sidewall 72 and their respective left ends displaceable in the axial direction, in which case the rollers 61 and 62 can elongate solely on the left side while maintaining their right ends aligned with each other during operation.

Preferably, the convex portion 61*a* of the fuser roller 61 and the concave portion 62*b* of the pressure roller 62 have complementary shapes, and the convex portion 62*a* of the pressure roller 62 and the concave portion 61*b* of the fuser roller 61 have complementary shapes, so that the fuser and pressure rollers 61 and 62 establish close contact with each other with no space between the undulating surfaces 610 and 620 at least over the maximum compatible sheet width W under no-load conditions, i.e., when no force is applied to press the pressure roller 62 against the fuser roller 61.

For example, where one of the undulating surfaces 610 and 620 defines a sinusoidal curve of a given amplitude and frequency, it is desirable that the other one of the surfaces 610 and 620 defines a sinusoidal curve of the same amplitude and frequency to provide uniform close contact therebetween under no-load condition. In this case, when plotted against the position along the longitudinal axes, the thicknesses of the elastic layers 612 and 622 trace a pair of sinusoidal waveforms opposite in phase and identical in amplitude and frequency with respect to each other.

Establishing close contact between the rollers 61 and 62 under no-load conditions ensures good imaging performance of the fixing device 27, since any space left between the roller surfaces 610 and 620 would result in variation in pressure along the fixing nip N under load condition, i.e., when the pressure roller 62 is pressed against the fixing roller 61 upon mounting to the fixing device 27.

Further, preferably, the total thickness of the elastic layers 612 and 622 present between the rollers 61 and 62 is constant at every point along the fixing nip N when the rollers 61 and 62 contact each other under no-load conditions. This also ensures good imaging performance of the fixing device 27, since pressure at a specific point along the fixing nip N is substantially dependent on the amount of elastic material present between the metal cores 611 and 621 which are uniformly spaced from each other, so that variation in the total thickness of the metal layers 612 and 622 under no-load conditions would result in variation in nip pressure under load conditions.

Still further, preferably, the convex and concave portions of the fixing rollers 61 and 62 are contiguous to each other as in the embodiment depicted in FIGS. 4 through 6. This ensures good sheet feeding performance of the fixing device 27, since providing convex and concave portions at intervals would increase the risk of wrinkling a recording sheet corrugated between the undulating surfaces during passage through the fixing nip N.

Figure 7:
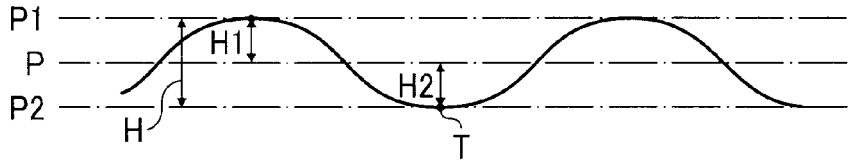
FIG. 7 shows a portion of an undulating surface of the fixing member used in the fixing device according to this patent specification.

FIG. 7 shows a portion of the undulating surface of the fixing member used in the fixing device 27 according to this patent specification, in which an imaginary line "P" represents a reference peripheral plane parallel to the longitudinal axis of the fixing member, "P1" represents an outer peripheral plane defined by apices of the convex portions, and "P2" represents an inner peripheral plane defined by apices of the concave portions.

As shown in FIG. 7, the undulating surface has an amplitude of undulation H defined as a total of H1 and H2, with H1 representing a distance from the outer peripheral plane P1 to the reference plane P (i.e., the height of convex portion), and H2 representing a distance from the inner peripheral plane P2 to the reference plane P (i.e., the height of concave portion). In the present embodiment, the reference plane P is equidistant from the outer and inner planes P1 and P2, so that the curve heights H1 and H2 are equal to half the undulation amplitude H. The values of H1, H2, and H may be established experimentally or theoretically, so as to effect good sheet feeding and image fixing performance of the fixing device 27 according to the specific application.

Preferably, the amplitude H of the undulating surface is in a range of approximately 0.16 mm to approximately 0.8 mm in the fixing nip N. Experiments have shown that an undulation amplitude H smaller than 0.16 mm results in an insufficient amount of curvature of a recording sheet corrugated by passing through the fixing nip N, meaning insufficient sheet stiffening effect of the undulating fixing members, whereas an undulation amplitude H greater than 0.8 mm results in a significant inconsistency in rotational speed at convex and concave portions of the rollers, which can wrinkle a recording sheet passing through the fixing nip N.

As mentioned, the undulating surface of the fixing member is formed by varying the thickness of the elastic layer along the longitudinal axis. Thus, the undulation amplitude H indicates a difference between maximum and minimum thicknesses of the elastic layer along the longitudinal axis. Since the elastic layer is compressed at a certain compression ratio under pressure within the fixing nip N, the undulation amplitude H varies depending on whether the fixing member is under load condition or no-load condition.

For example, the elastic layers 612 and 622 of the fixing rollers 61 and 62 may be compressed to approximately 80% of their original thicknesses (i.e., at a compression ratio of approximately 20% or less) under load conditions, in which case the undulation amplitude H outside the fixing nip N is approximately 1.25 times greater than that within the fixing nip N. Using a compression ratio exceeding 20% is undesirable since it can develop plastic deformation of the material constituting the elastic layer, leading to noises generated during operation, imperfection in resulting images, and other malfunctions of the fixing device 27.

Where the elastic layers 612 and 622 are compressed at a compression ratio of approximately 20%, the amplitude H of the undulating roller surfaces 610 and 620 may be in a range of approximately 0.16 mm to approximately 0.8 mm under load condition, and in a range of approximately 0.2 mm to approximately 1 mm (equivalent to curve heights H1 and H2 ranging from approximately 0.1 mm to approximately 0.5 mm) under no-load conditions.

Figure 8:
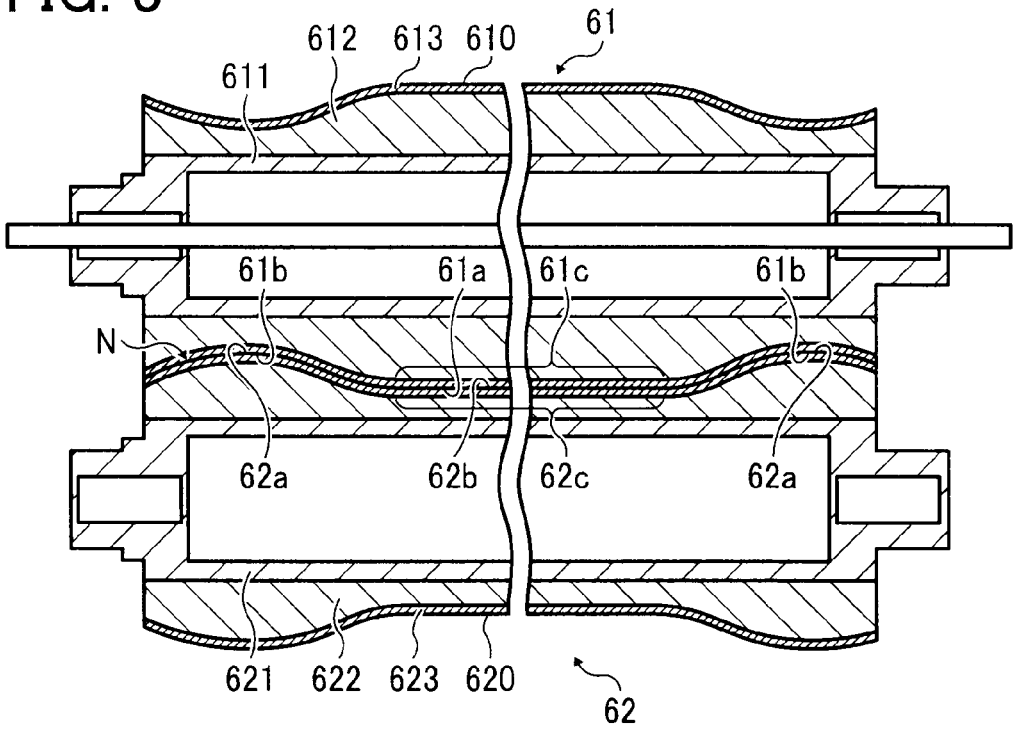
FIG. 8 shows the fuser roller and the pressure roller mounted in the fixing device of FIG. 3 according to further embodiment of this patent specification.
Figure 9:
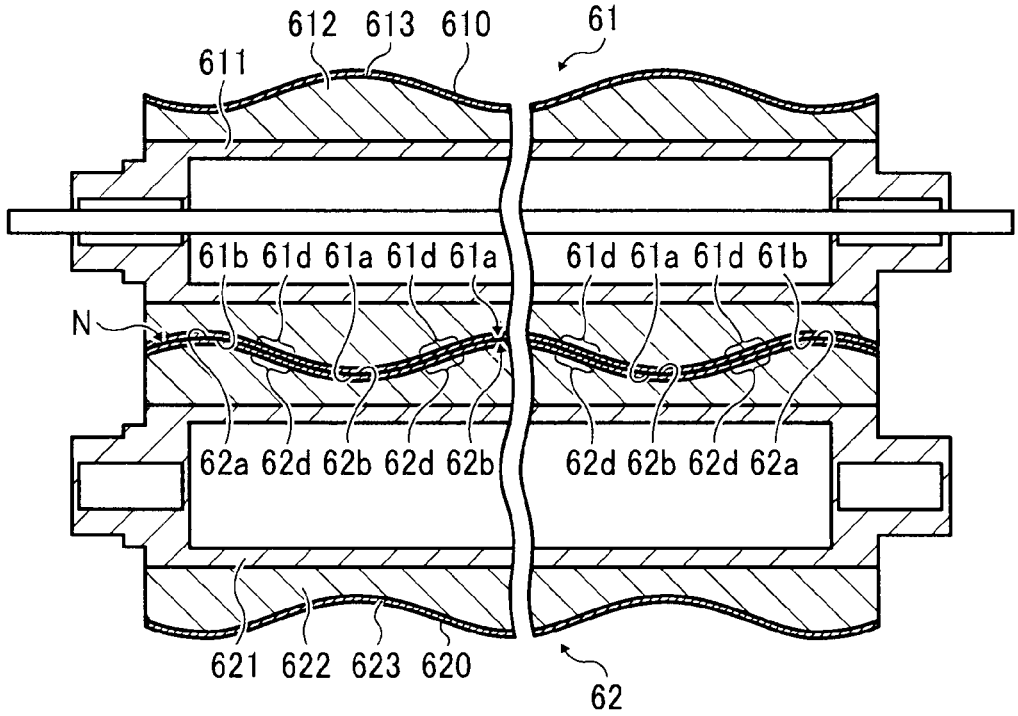
FIG. 9 shows the fuser roller and the pressure roller mounted in the fixing device of FIG. 3 according to still further embodiment of this patent specification.

In further embodiments, the undulating fixing rollers 61 and 62 may have other configurations than that depicted in FIGS. 4 through 7, wherein each roller has convex and/or concave portions that are partially straight, i.e., exhibiting substantially no curvature, in the axial direction. FIGS. 8 and 9 show examples of such configurations.

As shown in FIG. 8, the convex portion 61*a* of the fuser roller 61 may have a flat apex 61*c* that has a profile parallel to the longitudinal axis of the roller 61 and exhibits substantially no curvature in the axial direction, and the concave portion 62*b* of the pressure roller 62 may have a flat apex 62*c* that has a profile parallel to the longitudinal axis of the roller 62 and exhibits substantially no curvature in the axial direction. The flat portions 61*c* and 62*c* are formed without sharp edges or corners on their perimeters, so that the undulating surfaces 61 and 62 are generally smooth and continuous across the fixing nip N.

Alternatively, as shown in FIG. 9, the convex and concave portions 61*a* and 61*b* of the fuser roller 61 may have a flat taper 61*d* therebetween that has a profile diagonal to the longitudinal axis of the roller 61 and exhibits substantially no curvature in the axial direction, and the convex and concave portions 62*a* and 62*b* of the pressure roller 62 may have a flat taper 62*d* therebetween that has a profile diagonal to the longitudinal axis of the roller 62 and exhibits substantially no curvature in the axial direction. The flat portions 61*d* and 62*d* are formed without sharp edges or corners on their perimeters, so that the undulating surfaces 61 and 62 are generally smooth and continuous across the fixing nip N.

Except for the flat portions forming part of or connecting with the convex and concave portions, the embodiments depicted in FIGS. 8 and 9 include features identical to those depicted in the embodiment of FIG. 6, such as the undulating roller surfaces formed by varying the elastic layers and the mounting mechanism for ensuring engagement of the undulating surfaces, of which further description is omitted for brevity.

Figure 10:
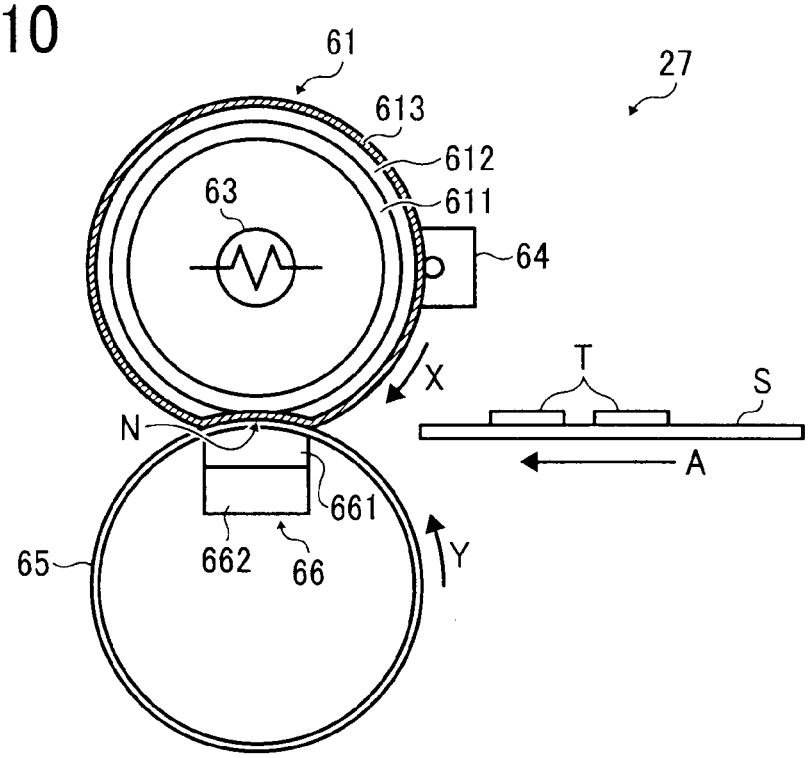
FIG. 10 is an end-on, axial view schematically illustrating yet still further embodiment of the fixing device incorporated in the image forming apparatus according to this patent specification.

FIG. 10 is an end-on, axial view schematically illustrating another embodiment of the fixing device 27 incorporated in the image forming apparatus 1 according to this patent specification.

As shown in FIG. 10, the present embodiment is similar to that depicted in FIG. 3, except that the pressure roller 62 is replaced by a stationary pressure member 66 pressed against the fuser roller 61 through a fixing belt 65. The fuser roller 61 can rotate around the longitudinal axis while contacting the pressure member 66 to define a fixing nip N therebetween, through which the fixing belt 65 rotates around the pressure member 66 upon rotation of the fuser roller 61.

The fuser roller 61 is configured in a manner similar to that depicted above, formed of the hollow, cylindrical metal core 611 covered by the layer of elastic material 612 with the coating of release agent 613 applied to the outer surface of the elastic layer 612, and having the lamp heater 63 and the thermometer 64 to control temperature of the outer surface.

The pressure member 66 is formed of a substantially flat, planar substrate 662 covered by a layer 661 of elastic material such as silicon rubber. The pressure member 66 has a biasing mechanism, not shown, that presses the pressure member 66 against the fuser roller 61 through the fixing belt 65.

The fixing belt 65 comprises an endless smooth belt formed of a suitable flexible material such as a polyimide film and loosely looped around the pressure member 66 without constricting the pressure member 66.

During operation, the fixing device 27 rotates the fuser roller 61 in the direction of arrow X and the fixing belt 65 in the direction of arrow Y to feed a recording sheet S bearing a powder toner image T thereon in the direction of arrow A. At the same time, the fixing device 27 heats the outer surface of the fuser roller 61 to a process temperature sufficient to melt toner particles. As the sheet S enters the fixing nip N, the toner image T comes into contact with the heated surface of the fuser roller 61. At the fixing nip, the fuser roller 61 melts the toner particles with heat, while the pressure member 66 promotes settling of the molten toner by pressing the sheet S between the fixing belt 65 and the fuser roller 61. The toner image T thus processed under heat and pressure then cools and solidifies and becomes fixed in place as the sheet S leaves the fixing nip N to advance along the sheet feed path A.

Figure 11:
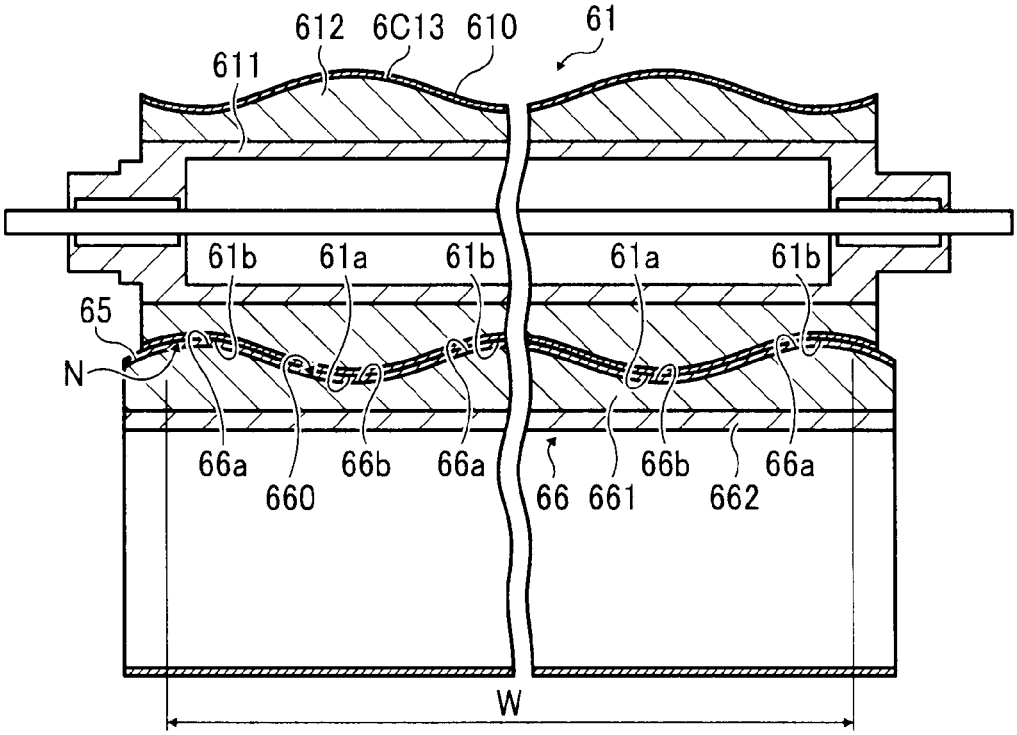
FIG. 11 shows a fuser roller and a pressure member installed in the fixing device of FIG. 10.

FIG. 11 shows the fuser roller 61 and the pressure member 66 installed in the fixing device 27, with the biasing mechanism of the pressure member 66 omitted for clarity.

As shown in FIG. 11, the configuration of the fuser roller 61 is similar to that depicted in FIG. 6 with its undulating surface 610 having the alternating series of at least one convex portion 61*a* and at least one concave portion 61*b* formed by varying the thickness of the elastic layer 612 along the longitudinal axis.

The pressure member 66 has an alternating series of at least one convex portion 66*a* curving outward and at least one concave portion 66*b* curving inward with respect to the longitudinal axis to define an undulating outer peripheral surface 660. The convex and concave portions 66*a* and 66*b* are formed by varying the thickness of the elastic layer 661, with the substrate 662 having a substantially uniform thickness or cross-section along the longitudinal axis.

Each of the convex and concave portions 66*a* and 66*b* has a height with respect to a circumferential plane of the fixing member 66 in a range of, for example, approximately 0.1 mm to approximately 0.5 mm, and a width along the longitudinal axis of the fixing member 66 of, for example, approximately 10 mm. The number of convex portions 66*a* and concave portions 66*b* each may be any number equal to or greater than one.

In the present embodiment, the convex portion 66*a* and the concave portion 66*b* are contiguous to each other so that the outer surface 660 as a whole has a continuously undulating configuration, such as a sinusoidal curve or other suitable curve, similar to those depicted in the embodiments depicted above. As in the case for the fuser roller 61, the series of convex and concave portions 66*a* and 66*b* of the pressure member 66 may span all or part of the maximum compatible sheet width W.

In the fixing device 27, the fuser roller 61 has the same number of convex portions 61*a* as the number of concave portions 66*b* of the pressure member 66, and the pressure member 66 has the same number of convex portions 66*a* as the number of concave portions 61*b* of the fuser roller 61. The convex portions 61*a* of the fuser roller 61 are similar in dimension and position, and preferably, complementary in shape, to the concave portions 66*b* of the pressure member 66 in the axial direction, and the convex portions 66*a* of the pressure member 66 are similar in dimension and position, and preferably, complementary in shape, to the concave portions 61*b* of the fuser roller 61 in the axial direction.

When properly mounted, the fuser roller 61 and the pressure member 66 have the cylindrical metal core 611 and the substrate 662 uniformly spaced apart from each other and their undulating surfaces 610 and 660 engaged in pressure contact with each other through the fixing belt 65 along the fixing nip N, with each convex portion 61*a* of the fuser roller 61 fitting in the corresponding concave portion 66*b* of the pressure member 66, and each convex portion 66*a* of the pressure member 66 fitting in the corresponding concave portion 61*b* of the fuser roller 61. The fixing belt 61 bends and conforms to the undulating surfaces 610 and 660 when sandwiched between the fuser roller 610 and the pressure member 660, and recovers its original smooth shape when released from the fixing nip N.

In such a configuration, the fixing device 27 according to this patent specification can temporarily stiffen a recording sheet S during passage through the fixing nip N, so as to reliably feed the sheet S without wrapping around the fuser roller 61 even when the sheet S in use is relatively thin and consequently ready to bend and deviate from the proper feed path A.

Specifically, with additional reference to FIG. 10, passing a recording sheet S through the fixing nip N causes the sheet S to conform to the undulating surfaces 610 and 660 of the fuser roller 61 and the pressure member 66. As the sheet S thus becomes undulated and corrugated, it temporarily exhibits an apparent stiffness greater than that exhibited without corrugation. Such temporary stiffening effect enables the recording sheet S to advance past the fixing nip N without wrapping around the fuser roller 61 and causing a jam at the fixing nip N, even when the sheet S in use is relatively thin and ready to bend due to adhesion of molten toner to the surface of the fuser roller 61.

Moreover, the fixing device 27 according to this patent specification can maintain a uniform pressure distribution throughout the fixing nip N to provide fixing with uniform gloss across a resulting image.

Specifically, the fuser roller 61 and the pressure member 66 contact each other at substantially uniform pressure along the fixing nip N owing to the engagement between the undulating surfaces 610 and 660 provided by fitting the corresponding convex and concave portions together. Since gloss of an image printed on a recording medium depends on the pressure applied to the recording medium during fixing process, the uniform nip pressure exerted on the recording sheet S during passage through the fixing nip N provides uniform gloss across the resulting image T.

Although not depicted in FIG. 11, the fixing members 61 and 66 are mounted in the fixing device 27 with a mounting mechanism similar to that depicted in FIG. 6, wherein the fixing members 61 and 66 have one pair of adjacent longitudinal ends positioned in alignment with each other, and the other pair of adjacent longitudinal ends displaceable along the respective longitudinal axes.

Thus, when the fixing members 61 and 66 expand along their respective longitudinal axes by being heated to the processing temperature during operation, they elongate solely on one side while maintaining their ends on the other side aligned with each other. This reduces the risk of misaligning corresponding concave and convex portions of the fixing members 61 and 66 after installation of the fixing device 27, which would otherwise detract from uniform nip pressure and from uniform gloss of a resulting image processed by the fixing device.

Preferably, the convex portion 61*a* of the fuser roller 61 and the concave portion 66*b* of the pressure member 66 have complementary shapes, and the convex portion 66*a* of the pressure member 66 and the concave portion 61*b* of the fuser roller 61 have complementary shapes, so that the fuser and pressure members 61 and 66 establish close contact with each other with no space between the undulating surfaces 610 and 660 at least over the maximum compatible sheet width W under no-load conditions.

For example, where one of the undulating surfaces 610 and 660 defines a sinusoidal curve of a given amplitude and frequency, it is desirable that the other one of the surfaces 610 and 660 defines a sinusoidal curve of the same amplitude and frequency to provide uniform close contact therebetween under no-load condition. In this case, when plotted against the position along the longitudinal axes, the thicknesses of the elastic layers 612 and 662 trace a pair of sinusoidal waveforms opposite in phase and identical in amplitude and frequency with respect to each other.

Further, preferably, the total thickness of the elastic layers 612 and 661 present between the fixing members 61 and 66 is constant at every point along the fixing nip N when they contact each other under no-load conditions.

Still further, preferably, the convex and concave portions of the undulating fixing members 61 and 66 are contiguous to each other as in the present embodiment depicted in FIG. 11.

Still further, preferably, the amplitude H of the undulating surfaces 610 and 660 is in a range of approximately 0.16 mm to approximately 0.8 mm under load condition. Where the elastic layers 612 and 622 is compressed at a compression ratio of approximately 20%, the amplitude H of the undulating surfaces 610 and 660 may be in a range of approximately 0.16 mm to approximately 0.8 mm under load condition, and in a range of approximately 0.2 mm to approximately 1 mm under no-load conditions.

Experiments described below were conducted to evaluate the efficacy of the fixing device 27 in terms of sheet feeding performance and uniformity in nip pressure, and specifically, those of the undulating fixing members according to this patent specification in comparison with conventional configurations of fixing members.

EXPERIMENT 1

Sheet stiffening effect of the undulating fixing roller was evaluated using fixing devices T1 through T3: test device T1 incorporating a pair of undulating rollers each having three convex and three concave portions to form undulations with an amplitude of approximately 0.2 mm under no-load condition; test device T2 incorporating a pair of undulating rollers each having seven convex and seven concave portions to form undulations with an amplitude of approximately 0.2 mm under no-load condition; and test device T3 having a pair of simple cylindrical rollers each with no undulation on the outer surface for comparison purposes.

Figure 12:
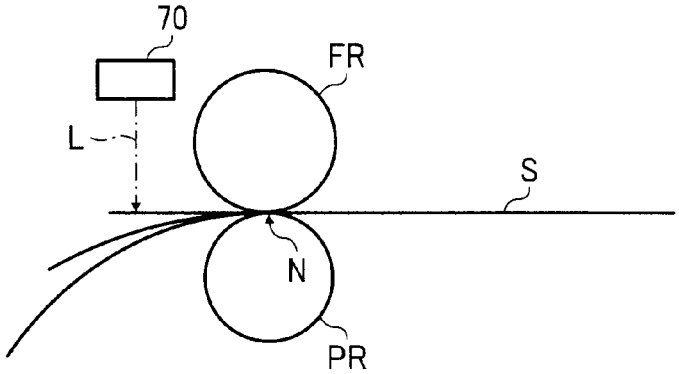
FIG. 12 shows test equipment used in experiments for evaluating sheet stiffening effect of the fixing device according to this patent specification.

Apparent stiffness exhibited by paper sheets during passage through the fixing nip was measured with equipment as shown in FIG. 12. As shown, the measurement equipment includes a laser displacement sensor 70 that directs a laser beam L toward a measurement point downstream of a fixing nip N defined between a fuser roller FR and a pressure rollers PR to obtain an amount by which a paper sheet S displaces from a reference plane representing the proper sheet feed path as it passes the measurement point.

In measurement, the paper sheet S was fed into the fixing nip N along the sheet feed path. As the leading edge of the sheet S reached the measurement point, the rollers FR and PR stopped rotation to hold the sheet S at the fixing nip N, and the displacement sensor 70 measured the displacement of the sheet S from the proper sheet feed path. Then, the rollers FR and PR resumed rotation to advance the sheet S by a given distance, and the displacement sensor 70 again measured the displacement of the sheet S from the proper sheet feed path.

After measurement, apparent stiffness of the paper sheet S during passage through the fixing nip N was determined based on an amount by which the sheet S was bent away from the sheet feed path, calculated as a difference between the displacements of the sheet S measured as it reaches and advances past the measurement point downstream the fixing nip N. The experiments were conducted on each test device using three types of paper sheets: thin paper S1 weighing 64 grams per square meter ($g/m^2$), thick paper S2 weighing 69 $g/m^2$, and very thick paper S3 weighing 90 $g/m^2$.

Figure 13:
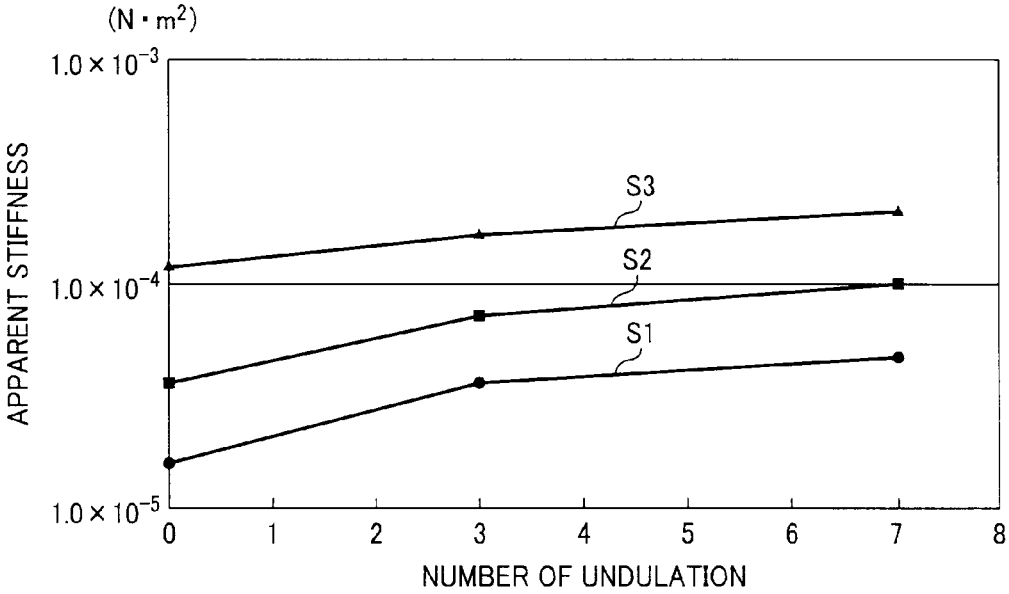
FIG. 13 is a graph plotting measurements of apparent stiffness of paper sheets obtained through the experiments.

FIG. 13 is a graph plotting measurements of apparent stiffness of the paper sheets S1 through S3 in $N*m^2$ against number of undulations per roller of the fixing device. In this graph, the undulation number of 3 indicates measurements obtained using the test device T1, of 7 indicates those obtained using the test device T2, and of 0 indicates those obtained using the comparative example T3.

As shown in FIG. 13, all the three types of paper sheets S1 through S3 exhibited greater values of apparent stiffness with the test devices T1 and T2 than with the device T3. Moreover, the apparent stiffness of each type of paper S obtained with the device T2 with seven undulations is greater than that obtained with the device T1 with three undulations.

The experimental results show that passing a paper recording sheet through a nip defined between a pair of undulating rollers increases the apparent stiffness of the sheet compared to that exhibited by the sheet passed through a nip defined between a pair of perfectly cylindrical rollers, which demonstrates the sheet stiffening effect provided by the fixing device 27 according to this patent specification. Also, comparison of the test devices T1 and T2 with different numbers of roller undulations indicates that the stiffening effect of the undulating roller increases with the number of undulations.

EXPERIMENT 2

Sheet stiffening effect of an undulating roller pair was evaluated using fixing devices T4 and T5: test device T4 with a pair of rollers each having only a single convex or concave portion forming a simple outward or inward curve on the roller surface; and test device T5 with a pair of rollers each having a single convex portion and a single concave portion together forming one undulation on the roller surface.

In Experiment 2, apparent stiffness of a recording sheet during passage through the fixing nip N was measured using multiple sets of test devices with varying amplitudes of curve or undulation for each of the fixing devices T4 and T5.

Figure 14A:
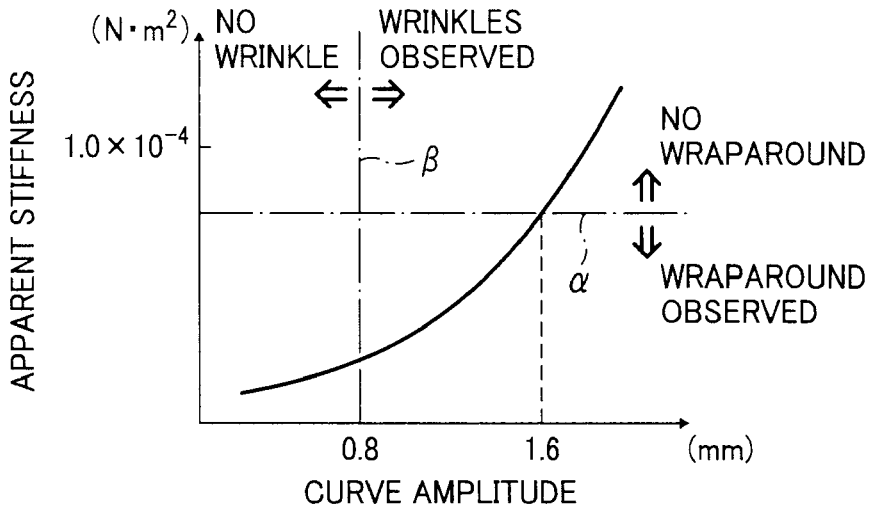
FIGS. 14A and 14B are graphs plotting measurements of apparent sheet stiffness against amplitude of curve or undulation of test devices obtained through the experiments.
Figure 14B:
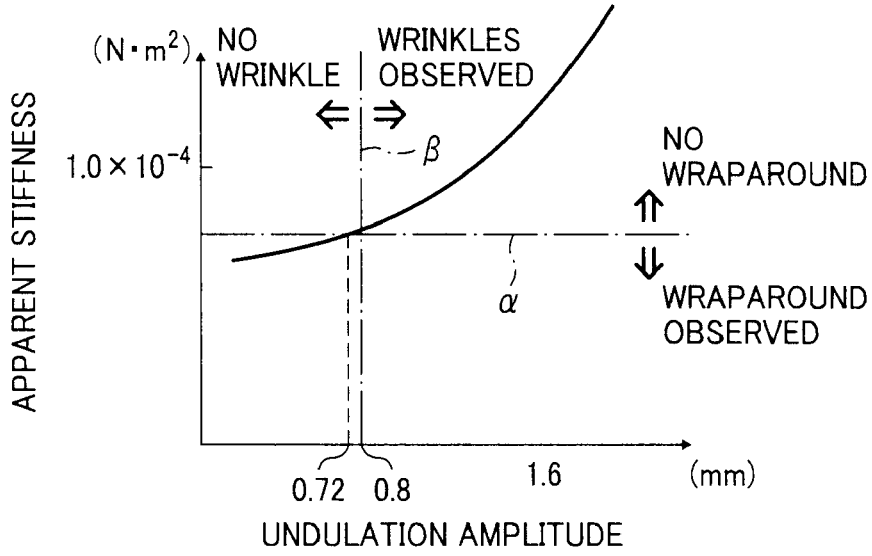

FIGS. 14A and 14B are graphs plotting measurements of apparent sheet stiffness in $N*m^2$ against the amplitude of curve or undulation in mm of the test devices T4 and T5, respectively, obtained through Experiment 2. In the graphs, a line $\alpha$ represents a minimum allowable sheet stiffness with which the fixing device can feed a recording sheet through the fixing nip without wrapping around the fuser roller, and a line $\beta$ represents a maximum allowable amplitude of curve or undulation with which the fixing device can forward a recording sheet without causing wrinkles on the sheet.

As shown in FIGS. 14A and 14B, an increase in apparent sheet stiffness was effected by increasing the amount of curve or undulation amplitude in each of the test devices T4 and T5, and the sheet stiffening effect at a given curve/undulation amplitude observed in the device T5 was significantly greater than that observed in the device T4.

Specifically, as shown in FIG. 14A, the apparent stiffness of the recording sheet obtained using the device T4 reaches the minimum allowable stiffness $\alpha$ at a curve amplitude of approximately 1.6 mm which is beyond the maximum allowable amplitude $\beta$ of 0.8 mm. This means that the recording sheet can pass through the fixing nip N without wraparound but with wrinkles when the curve amplitude is over 1.6 mm, and without wrinkles but with wraparound when the curve amplitude is below 0.8 mm.

On the other hand, as shown in FIG. 14B, the apparent stiffness of the recording sheet obtained using the device T5 reaches the minimum allowable stiffness $\alpha$ at an undulation amplitude of approximately 0.72 mm which is below the maximum allowable amplitude $\beta$ of 0.8 mm. This means that the recording sheet can pass through the fixing nip N without wrinkles and/or wraparound where the amplitude of undulation is in the range of 0.72 mm to 0.8 mm.

The experimental results show that the pair of undulating rollers is superior to the pair of simply curved rollers in terms of sheet stiffening effect obtained with a given value of curve/undulation amplitude, in which feeding the recording sheet without wraparound and wrinkles is possible with the pair of undulating rollers with adequate undulation amplitude, but not with the pair of simply curved rollers. This demonstrates the superiority of the fixing device according to this patent specification having a pair of undulating rollers each with at least one undulation, of which the sheet stiffening effect may be further enhanced by increasing the number of undulations as indicated by the results of Experiment 1.

EXPERIMENT 3-1

Uniformity in nip pressure effected by a pair of undulating rollers was evaluated using two types of fixing devices T6 and T7: device T6 having a pair of undulating rollers each formed of a cylindrical metal core covered with an elastic layer of varying thickness along the longitudinal axis; and device T7 having a pair of undulating rollers each formed of a metal core of varying diameter along the longitudinal axis covered with an elastic layer of uniform thickness.

Figure 15:
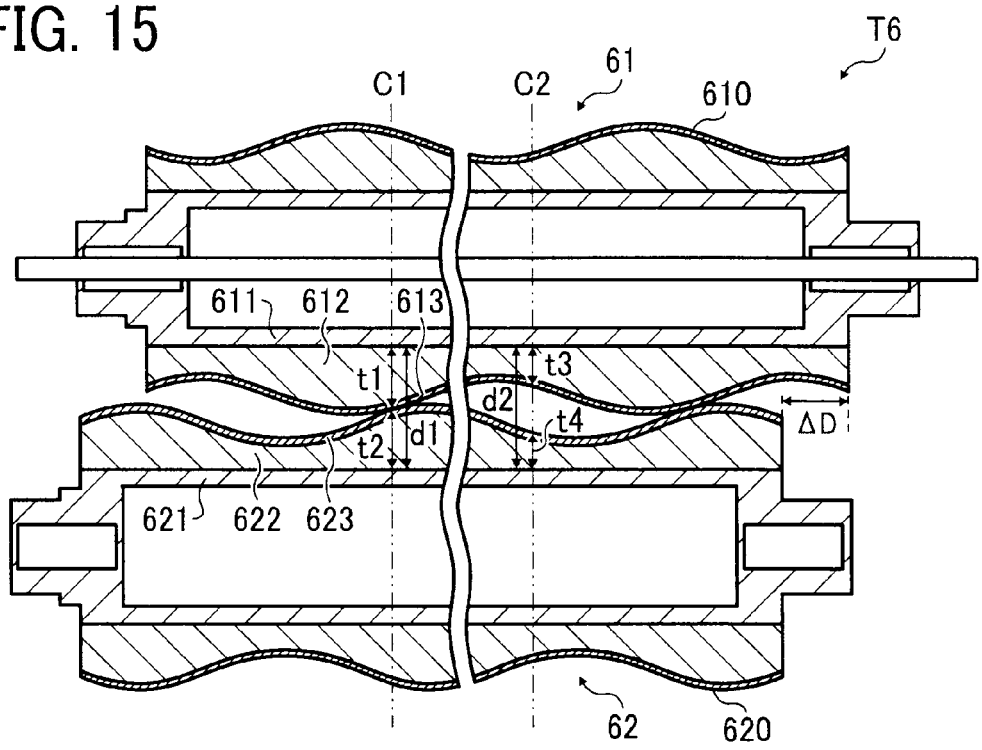
FIGS. 15 and 16 schematically illustrate the fixing devices used in experiments for evaluating uniformity in nip pressure of the fixing device according to this patent specification.
Figure 16:
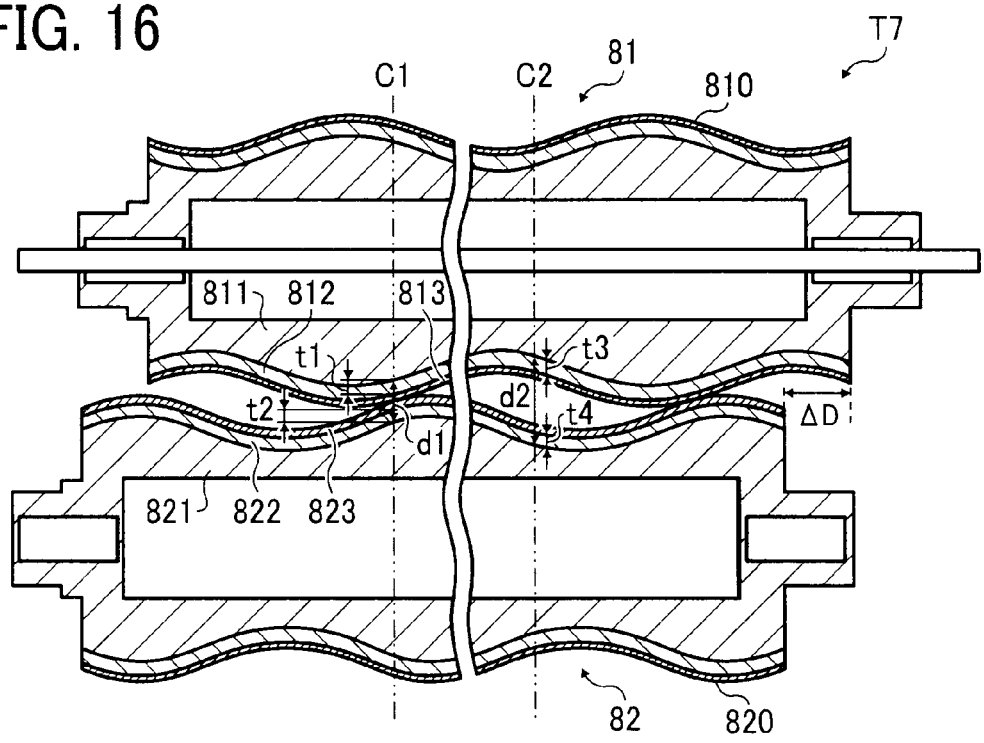

FIGS. 15 and 16 schematically illustrate the fixing devices T6 and T7, respectively, used in Experiment 3-1.

As shown in FIG. 15, the fixing device T6 has a pair of fuser roller 61 and a pressure roller 62 according to this patent specification, wherein the fuser roller 61 consists of a cylindrical metal core 611 covered with an elastic layer 612 of varying thickness and a uniform coating of release agent 613 to form an undulating outer surface 610, and the pressure roller 62 consists of a cylindrical metal core 621 covered with an elastic layer 622 of varying thickness and a uniform coating of release agent 623 to form an undulating outer surface 620.

As shown in FIG. 16, the fixing device T7 has a pair of fuser roller 81 and a pressure roller 82 similar to but different from the undulating fixing rollers 61 and 62 according to this patent specification, wherein the fuser roller 81 consists of a metal core 811 of varying diameter covered with a uniform elastic layer 812 and a uniform coating of release agent 813 to form an undulating outer surface 810, and the pressure roller 82 consists of a metal core 821 of varying diameter covered with a uniform elastic layer 822 and a uniform coating of release agent 823 to form an undulating outer surface 820.

In Experiment 3-1, the pair of undulating fixing rollers were intentionally displaced relative to each other by an amount ΔD in the axial direction to simulate misalignment during operation (e.g., occurring due to thermal expansion of the rollers). Pressure along the fixing nip was measured by varying the roller displacement ΔD to obtain a plot of pressure distribution, from which an amplitude of nip pressure variation ΔP was determined as a difference between maximum and minimum pressures observed along the fixing nip.

Figure 17:
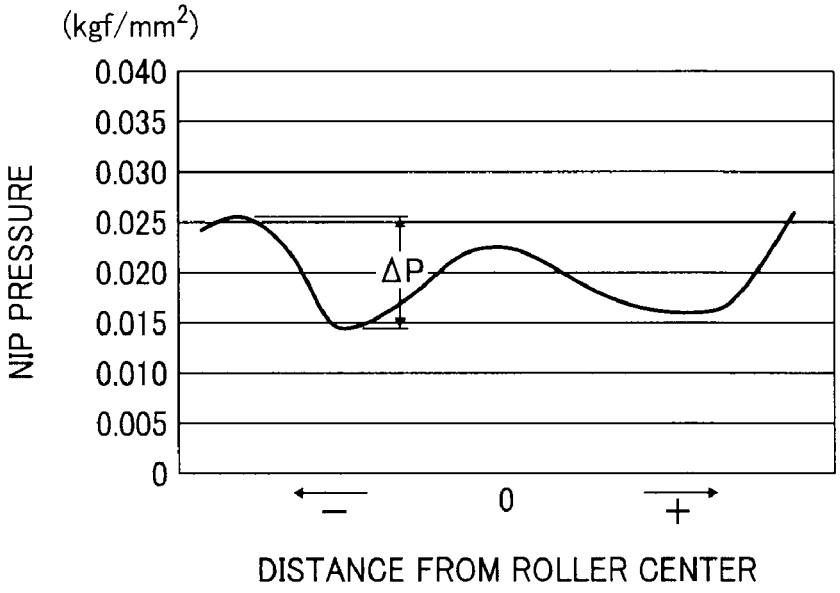
FIG. 17 shows an example of nip pressure distribution plotted against position relative to roller center obtained through the experiments.

FIG. 17 shows an example of nip pressure distribution plotted in kilogram-force per square mm (kgf/mm$^2$) against position relative to the center O of the roller along the fixing nip, based on which a nip pressure variation ΔP of approximately 0.01 kgf/mm$^2$ is determined for a particular value of roller displacement ΔD.

Figure 18:
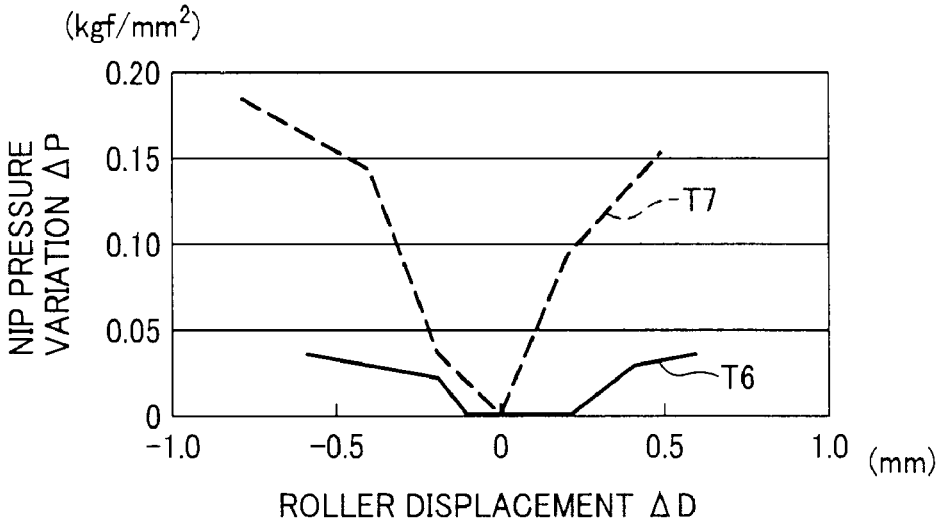
FIG. 18 shows a graph plotting nip pressure variation against roller displacement obtained through the experiments.

FIG. 18 shows graphs plotting nip pressure variation ΔP in kgf/mm$^2$ against roller displacement ΔD in mm obtained through Experiment 3-1, with the solid line representing a plot for the fixing device T6, and the broken line a plot for the fixing device T7. The measurement values shown here do not take into account the amount of bending experienced by the roller metal cores, which may not have noticeably influenced the nip pressure measured.

As shown in FIG. 18, in both cases T6 and T7, the nip pressure variation ΔP increases as the roller displacement ΔD increases. However, it is to be noted that the fixing device T6 exhibits a significantly low level of nip pressure variation ΔP compared to that of the comparative example T7 for each value of roller displacement ΔD. Such a difference in the overall level of nip pressure variation stems from a difference in structure existing between the longitudinal axes of the fixing rollers to define the fixing nip.

Referring back to FIG. 15, the fixing device T6 has a uniform gap between the cylindrical metal cores 611 and 621 and a varying total thickness of the elastic layers 612 and 622 when the rollers 61 and 62 are displaced relative to each other in the axial direction. That is, a gap d1 defined between the metal cores 611 and 621 at a position C1 where the rollers 61 and 62 contact each other is equal to a gap d2 defined between the metal cores 611 and 621 at a position C2 where the rollers 61 and 62 are farthest from each other, whereas a total of elastic layer thicknesses t1 and t2 at the position C1 is greater than a total of elastic layer thicknesses t3 and t4 at the position C2.

On the other hand, as shown in FIG. 16, the fixing device T7 has a varying gap between the cylindrical metal cores 811 and 821 and a uniform total thickness of the elastic layers 812 and 822 when the rollers 81 and 82 are displaced relative to each other in the axial direction. That is, a gap d1 defined between the metal cores 811 and 821 at a position C1 where the rollers 81 and 82 contact each other is smaller than a gap d2 defined between the metal cores 811 and 821 at a position C2 where the rollers 81 and 82 are farthest from each other, whereas a total of elastic layer thicknesses t1 and t2 at the position C1 is equal to a total of elastic layer thicknesses t3 and t4 at the position C2.

Hence, in the fixing device T6, variation in nip pressure is attributable to the difference in the total thickness of the elastic layers 612 and 622 present within the fixing nip N, whereas in the fixing device T7, variation in nip pressure is attributable to the difference in the gap between the metal cores 811 and 821 at the fixing nip N. Considering that the metal core has a higher stiffness or Young's modulus than that of the layer of elastic material, it can be seen that the nip pressure is affected by a variation in the gap between the metal cores rather than by a variation in the total thickness of the elastic layers. When taken together, these facts explain the significant difference between the overall levels of nip pressure variation of the fixing devices T6 and T7 observed in Experiment 3-1.

EXPERIMENT 3-2

Variation in gloss of a printed image was measured in relation to variation in pressure along a fixing nip. In Experiment 3-2, image gloss was measured using a gloss meter (model PG-1M manufactured by NIPPON DENSHOKU INDUSTRIES CO., LTD) with a measurement angle of 60° for different values of nip pressure variation, and the gloss variation was determined as a difference between maximum and minimum gloss values across an image printed with a particular value of the nip pressure variation.

Figure 19:
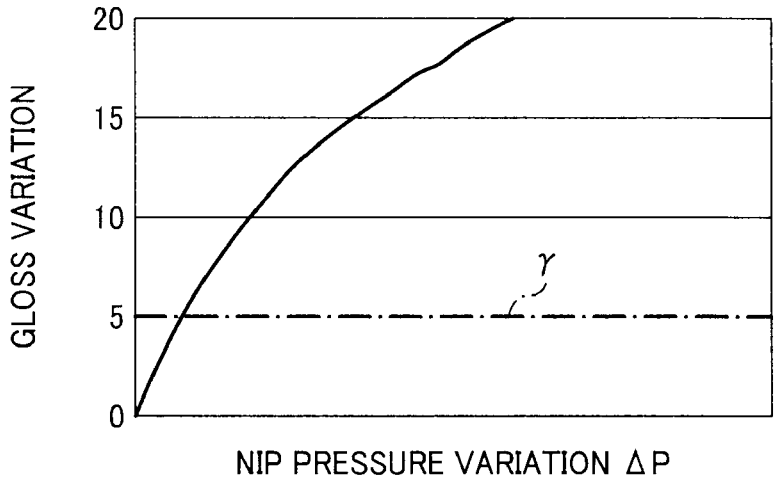
FIG. 19 is a graph showing a relation between image gloss variation and nip pressure variation obtained through the experiments.

FIG. 19 is a graph showing a relation between the image gloss variation and the nip pressure variation (gloss and pressure units omitted) obtained through Experiment 3-2.

As shown in FIG. 19, the image gloss variation increases as the nip pressure variation increases, which verifies the fact that variation in nip pressure translates into variation in gloss of printed images. In the graph, the broken dotted line indicates a level of image gloss variation γ (approximately at 5) that does not cause noticeable irregularities in resulting images with either a high gloss or low gloss on their surfaces. The graph indicates that printing images with the allowable level of gloss variation γ requires a sufficiently low level of nip pressure variation.

EXPERIMENT 3-3

Variation in gloss of a printed image was measured using the two types of fixing devices T6 and T7 used in Experiment 3-1 by varying the amount of roller displacement ΔD.

Figure 20:
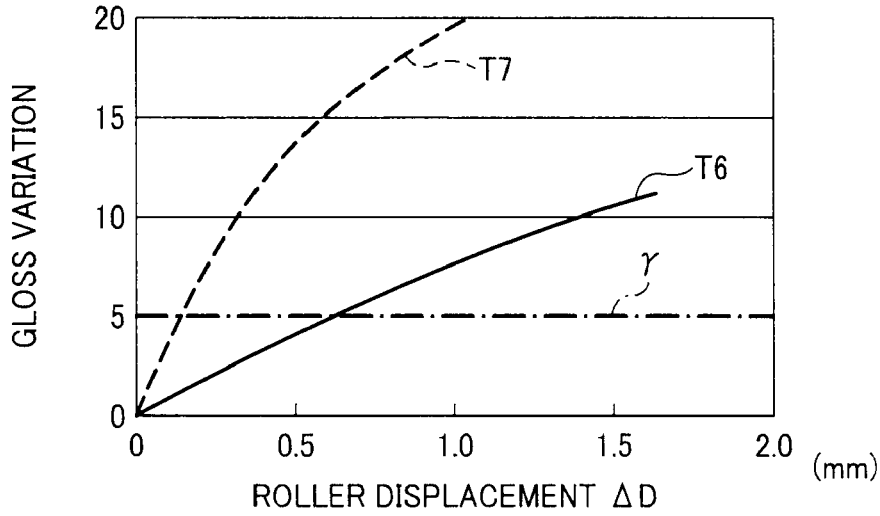
FIG. 20 is a graph plotting variation in gloss against roller displacement obtained through the experiments.

FIG. 20 is a graph plotting the variation in gloss (unit omitted) against the roller displacement in mm, with the solid line representing the plot for the fixing device T6, and the broken line the plot for the comparative example T7.

As shown in FIG. 20, the fixing device T6 exhibits a significantly lower level of gloss variation in relation to the roller displacement compared to that of the fixing device T7. This result is consistent with the fact that the fixing device T6 exhibits a significantly lower level of nip pressure variation in relation to the roller displacement compared to that of the fixing device T7 (see FIG. 18), and the image gloss variation increases with the nip pressure variation (see FIG. 19).

Further, the fixing device T6 has an image gloss variation below the maximum allowable level γ of 5 as long as the roller displacement ΔD is in the range of 0 to approximately 0.5 mm. As mentioned earlier with reference to FIG. 6, the fixing device according to this patent specification can maintain the roller displacement within 0.5 mm or less owing to the mounting mechanism which secures the adjacent ends of the rollers on only one side of their longitudinal axes. Consequently, the fixing device T6 can maintain the image gloss variation below the maximum allowable level γ of 5 by applying the mounting mechanism according to this patent specification.

The experimental results indicate that the fixing device according to this patent specification can reliably provide printing with uniform gloss across the image with the pair of undulating rollers formed by varying the thickness of elastic layers, and such uniformity in gloss is ensured by providing the mounting mechanism which prevents excessive displacement of the rollers relative to each other.

Although the experiments described above were conducted on a fixing device with a pair of undulating fixing rollers, the results of these experiments give evidence of and explain the efficacy of other configurations of the fixing device according to this patent specification, such as those with fixing members with partially straight convex and concave portions, and those using a stationary pressure member with a fixing belt in place of a pressure roller, since the fundamental mechanism that provides the sheet stiffening effect and the uniform nip pressure is common to all the embodiments of the fixing device depicted in this patent specification.

Numerous additional modifications and variations are possible in light of the above teachings. For example, although the fixing device 27 is described as being incorporated in the multicolor printer 1 as shown in FIG. 2, the fixing device according to this patent specification is applicable to various types of electrophotographic image forming apparatus, such as monochrome printers, photocopiers, facsimiles, or multifunctional machines incorporating several of these imaging functions. It is therefore to be understood that, within the scope of the appended claims, the disclosure of this patent specification may be practiced otherwise than as specifically described herein.

What is claimed is:

1. A fixing device that fixes a toner image in place on a recording medium, the fixing device comprising:

a first member extending along a first longitudinal axis, the first member including a first elastic layer having a thickness that varies along a length of the first longitudinal axis to define at least one first convex portion curving outward and at least one first concave portion curving inward with respect to the first longitudinal axis; and a second member extending along a second longitudinal axis parallel to the first longitudinal axis, the second member including a second elastic layer having a thickness that varies along a length of the second longitudinal axis to define at least one second convex portion curving outward and at least one second concave portion curving inward with respect to the second longitudinal axis, wherein at least one of the first and second members is heated, and at least one of the first and second members is pressed against the other, with the first convex portion engaging the second concave portion and the first concave portion engaging the second convex portion, to define a fixing nip therebetween through which the recording medium is passed to fix the toner image under heat and pressure, and wherein first adjacent longitudinal ends of the first and second members, respectively, are aligned with each other, and second adjacent longitudinal ends of the first and second members, respectively, are displaceable along the respective first and second longitudinal axes.

2. The fixing device according to claim 1, wherein the first member comprises an internally heated fuser roller rotatable around the first longitudinal axis, and the second member comprises a pressure roller pressed against the fuser roller for rotation around the second longitudinal axis.

3. The fixing device according to claim 1, wherein the first member comprises an internally heated fuser roller rotatable around the first longitudinal axis, and the second member comprises a stationary pressure member pressed against the fuser roller through an endless, fixing belt looped for rotation around the pressure member.

4. The fixing device according to claim 1, wherein the corresponding convex and concave portions contact each other with no space therebetween in a no-load state in which the first and second members contact each other and no additional force is exerted between the first and second members.

5. The fixing device according to claim 1, wherein the first convex portion and the first concave portions are contiguous along the first longitudinal axis, and the second convex portion and the second concave portion are contiguous along the second longitudinal axis.

6. The fixing device according to claim 1, wherein each of the first and second members has convex and concave portions at least partially spanning a maximum width of recording medium that the fixing device can accommodate through the fixing nip.

7. The fixing device according to claim 1, wherein the first convex portion and the second concave portion are partially straight along the respective longitudinal axes.

8. The fixing device according to claim 7, wherein the first concave portion and the second convex portion are partially straight along the respective longitudinal axes.

9. The fixing device according to claim 1, wherein each of the first and second elastic layers has a difference between maximum and minimum thicknesses along the respective longitudinal axes in a range of approximately 0.16 mm to approximately 0.8 mm in a load state in which the first and second members are pressed against each other.

10. The fixing device according to claim 1, wherein a total of thicknesses of the first and second elastic layers between the first and second members is substantially constant at every point along the longitudinal axes in a no-load state in which the first and second members contact each other and no additional force is exerted between the first and second members.

11. The fixing device according to claim 1, wherein the first adjacent longitudinal ends of the first and second members are fixed to a sidewall of a housing that houses the fixing device.

12. The fixing device according to claim 1, wherein the second adjacent longitudinal ends of the first and second members are displaceable through a sidewall of a housing that houses the fixing device.

13. An image forming apparatus, comprising:

an electrophotographic mechanism to form a toner image on a recording medium; and a fixing unit to fix the toner image in place on the recording medium, the fixing unit including:

a first member extending along a first longitudinal axis, the first member including a first elastic layer having a thickness that varies along a length of the first longitudinal axis to define at least one first convex portion curving outward and at least one first concave portion curving inward with respect to the first longitudinal axis, and a second member extending along a second longitudinal axis parallel to the first longitudinal axis, the second member including a second elastic layer having a thickness that varies along a length of the second longitudinal axis to define at least one second convex portion curving outward and at least one second concave portion curving inward with respect to the second longitudinal axis, wherein at least one of the first and second members is heated, and at least one of the first and second members is pressed against the other, with the first convex portion engaging the second concave portion and the first concave portion engaging the second convex portion, to define a fixing nip therebetween through which the recording medium is passed to fix the toner image under heat and pressure, and wherein first adjacent longitudinal ends of the first and second members, respectively, are aligned with each other, and second adjacent longitudinal ends of the first and second members, respectively, are displaceable along the respective first and second longitudinal axes.

14. The image forming apparatus according to claim 13, wherein the first adjacent longitudinal ends of the first and second members are fixed to a sidewall of a housing that houses the fixing device.

15. The image forming apparatus according to claim 13, wherein the second adjacent longitudinal ends of the first and second members are displaceable through a sidewall of a housing that houses the fixing device.

* * * * *